US007017486B2

(12) United States Patent
Steffen et al.

(10) Patent No.: US 7,017,486 B2
(45) Date of Patent: Mar. 28, 2006

(54) METHOD AND APPARATUS FOR PRINTING A WEB

(75) Inventors: Volker Steffen, Herford (DE); Helmut Schneider, Melle (DE); Mathias Schulz, Bunde (DE)

(73) Assignee: Werner Kammann Maschinenfabrik GmbH, Bunde (DE)

( * ) Notice: Subject to any disclaimer, the term of this patent is extended or adjusted under 35 U.S.C. 154(b) by 90 days.

(21) Appl. No.: 10/456,225

(22) Filed: Jun. 6, 2003

(65) Prior Publication Data

US 2004/0177779 A1 Sep. 16, 2004

(30) Foreign Application Priority Data

Mar. 14, 2003 (DE) ..... 103 11 219

(51) Int. Cl.
*B41F 13/56* (2006.01)

(52) U.S. Cl. ..... 101/228; 101/219; 101/142; 101/484; 101/DIG. 42

(58) Field of Classification Search ..... 101/217, 101/228, 232, 219, 142, 424.1, 487, 488, 101/484, DIG. 42
See application file for complete search history.

(56) References Cited

U.S. PATENT DOCUMENTS

| | | | | |
|---|---|---|---|---|
| 4,066,016 | A | 1/1978 | Tison | |
| 4,245,538 | A | 1/1981 | Kammann et al. | |
| 4,245,554 | A | 1/1981 | Kammann et al. | |
| 4,372,206 | A | 2/1983 | Tison et al. | |
| 4,372,296 | A | 2/1983 | Fahim | |
| 4,688,485 | A | 8/1987 | Tison | |
| 5,092,241 | A * | 3/1992 | Feser et al. | 101/153 |
| 6,499,397 | B1 * | 12/2002 | Stern | 101/248 |
| 6,799,507 | B1 * | 10/2004 | Ohba et al. | 101/228 |
| 2001/0029862 | A1 * | 10/2001 | Hofmann et al. | 101/479 |
| 2002/0002916 | A1 * | 1/2002 | Sugiyama | 101/142 |
| 2002/0189470 | A1 * | 12/2002 | Holm | 101/375 |

FOREIGN PATENT DOCUMENTS

| | | |
|---|---|---|
| CH | 610 817 | 5/1979 |
| DE | 26 17 418 | 11/1976 |

(Continued)

OTHER PUBLICATIONS

Derwent English abstract for DE 26 17 418.

(Continued)

*Primary Examiner*—Andrew H. Hirshfield
*Assistant Examiner*—Kevin D. Williams
(74) *Attorney, Agent, or Firm*—Grossman Tucker Perreault & Pfleger, PLLC

(57) ABSTRACT

In a method and an apparatus for printing on material in web form print images are successively applied to the web by a transfer cylinder. The web is continuously drawn into the printing station and the speed at which the web is moved in the printing station during a printing operation is greater than the speed at which it is drawn into the printing station. After the printing operation the web is positioned in the printing station for the following printing operation relative to the transfer cylinder which is not in contact with the web during a part of a revolution of 360°, and at the same time the path of the web is altered in accordance with the change in the speed thereof. The web is driven by the impression cylinder which is associated with the transfer cylinder and around the peripheral surface of which the web partially passes. Positioning of the web for the respectively following printing operation is implemented by a change in the rotary movement of the impression cylinder.

18 Claims, 6 Drawing Sheets

FOREIGN PATENT DOCUMENTS

| | | |
|---|---|---|
| DE | 25 02 077 | 8/1978 |
| DE | 28 22 369 | 12/1979 |
| DE | 41 04 209 A1 | 8/1992 |
| EP | 0 018 291 | 10/1980 |
| EP | 0 159 225 | 10/1985 |
| GB | 1 498 292 | 1/1978 |
| GB | 2 198 265 A | 6/1988 |

OTHER PUBLICATIONS

Derwent English abstract for DE 28 22 369.
Esp@cenet English abstract for CH 610817.
EPO Search Report dated Jun. 17, 2004 received in corresponding EPO Application No. 04002866.4-2304 (3 pgs).

* cited by examiner

METHOD AND APPARATUS FOR PRINTING A WEB

FIELD OF THE INVENTION

The invention concerns a method and an apparatus for printing material in web form.

In this specification the term print image is used to denote a print image applied to a web of material, which may be a complete print image in itself, or alternatively a partial print image such that a plurality of such partial print images are applied to the web of material at the same location in order thereby to produce an overall print image, as is the case for example with multi-color printing.

Furthermore in this specification the term printing is intended to include any printing and decorating processes such as relief printing, for example flexographic printing, intaglio printing and rotary screen printing, but also stamping or embossing, in particular hot stamping or embossing, without however that list of possible processes being exhaustive.

BACKGROUND OF THE INVENTION

The operation of printing on material in web form is often implemented by using rotary printing machines which in general terms can be divided into two groups. In one group the diameter of the cylinder for transferring the print image on to the web, which is referred to hereinafter as the transfer cylinder, is adapted to the length of the print image in such a way that the external printing periphery of the cylinder corresponds to an image length or to a multiple of such an image length, possibly with the addition of a pattern repeat spacing. Operatively associated with that transfer cylinder is an impression cylinder around which the web of material to which printing is to be applied is passed. The transfer cylinder and the impression cylinder rotate continuously at a constant speed so that printing machines of that kind have a very high through-put capacity. A disadvantage with such a machine however is that, when changing from one print image to another, it is necessary to replace at least the transfer cylinder if the subsequent print image is of a different length because that then requires a transfer cylinder of a different diameter. That entails a correspondingly high level of complication and expenditure, especially as conversion of the machine in that way also requires a certain amount of time. For that reason printing machines of that kind are only suitable for producing large numbers of the same print image. That requirement however does not always arise.

In contrast, in the second group of printing machines for printing on material in web form, the transfer cylinder is such that the printingly operative peripheral surface can be adapted to different print image lengths without involving a high level of complication and expenditure. That can be achieved for example in offset printing by virtue of the fact that the peripheral surface of the transfer cylinder is formed by a rubber blanket which without difficulty can be replaced and/or easily adapted to the respective print image length. The transfer cylinders of that group of machines however are generally of such a design that their printingly operative peripheral surface extends over less than 360° so that particular precautions generally have to be taken to apply the print images to the web of material without any spacing or only with a small pattern repeat spacing. For that purpose after each working cycle the web has to be appropriately positioned for the respectively following working cycle in order in that way to permit printing on the web of material with small spacings between the individual print images.

In this respect reference may be made to EP 0 018 291 disclosing a machine configuration in which the printing mechanism has a drive roller which operates independently of the actual printing mechanism. A similar consideration also applies in regard to the printing machine of EP 0 159 225 B1 in which the transfer cylinder is admittedly of a completely cylindrical configuration but which also requires an additional drive means for positioning of the web of material.

SUMMARY OF THE INVENTION

An object of the present invention is to provide a method of printing on a web such that when making a transition from one print image to another it is possible to convert quickly to the new image format.

Another object of the invention is to provide a method of printing on material in web form, which permits accurate guidance and positioning of the web of material for the purposes of achieving a high level of quality of the print images produced on the web.

Still another object of the invention is to provide a method of printing a web of material which can afford a sufficiently high through-put capacity to satisfy at least the demands usually made nowadays.

Still a further object of the invention is to provide an apparatus for printing on material in web form, which is of a structure such as to permit easy conversion from one print image format to another while being of a simple structure but nonetheless ensuring a high print image quality at a high through-put rate.

In accordance with the principles of the present invention in the method aspect the foregoing and other objects are attained by a method of printing a material in web form, in which in a printing station print images are successively applied to the web from a transfer cylinder, the web being moved in a direction towards the printing station at an intake speed, while the speed at which the web is moved in the printing station during the printing operation is higher than the intake speed. After the printing operation the movement of the web in the printing station is modified in order to position the web for the following printing operation relative to the transfer cylinder which is not in contact with the web during a part of a complete revolution of 360°. The web is driven by an impression cylinder operatively associated with the transfer cylinder and having a peripheral surface around which the web is partially passed. The change in the movement of the web for positioning the web for the respective following printing operation is implemented by a suitable change in the rotary movement of the impression cylinder. The path of movement of the web in the at least one printing station is adjusted in dependence on the rotary movement of the impression cylinder to compensate for the differences between the intake movement of the web and the movements transmitted to the web by the impression cylinder, by the operation of a first compensation means.

Further in accordance with the invention in the apparatus aspect the foregoing and other objects are attained by an apparatus for printing on material in web form, including at least one printing station comprising a transfer cylinder for transferring print images on to the web and an impression cylinder for driving the web. Print images are applied successively to the web in the at least one printing station from the transfer cylinder which is not in contact with the web during a part of a complete revolution of 360°. The web is transported in the at least one printing station by the impression cylinder, around the peripheral surface of which the web partially passes. The apparatus has means for controlling the drive of the impression cylinder in such a way that the web can be suitably positioned relative to the transfer cylinder for the respectively following printing operation. The at least one printing station is provided with a first compensation means for deflecting the web, and means for reciprocating movement of the first compensation means in the direction of travel of the web upstream of the impression cylinder in dependence on the rotary movement of the impression cylinder, in such a way that the web forms at least a first loop which is variable in respect of its length in dependence on the movement of the first compensation means.

As will be seen from the description hereinafter of preferred embodiments of the invention, the invention which belongs to the second group of printing machines as discussed hereinbefore can be summarised to the effect that the web is driven by the impression cylinder in the printing station and is positioned by the impression cylinder after each printing operation for the respectively following working cycle. The length of the portion of web disposed in the region of the respective printing station is altered in dependence on the speed and direction of transportation movement of the web in order to compensate for a difference between the preferably uniform speed at which the web passes into the printing station and the transportation speed and direction respectively transmitted to the web by the impression cylinder. For that purpose there is provided a reciprocatable compensation means, the movements of which are co-ordinated with the speed and direction of rotary movement of the impression cylinder.

As the web at least partially passes around the impression cylinder which drives it, in addition to precise transfer of the rotary movement of the impression cylinder to the web, that provides for defined and rapid separation of the web from the transfer cylinder after the web had come into contact therewith for the purposes of transferring the print image from the transfer cylinder on to the web. That also promotes a high quality of the print image on the web.

As will further be seen from the description hereinafter of preferred embodiments, when using a blanket cylinder for transferring a print image on to the web, in order to simplify adjustment to a different print image length, the rubber blanket can be provided in the peripheral direction of the transfer cylinder with a portion of smaller thickness which remains out of contact with the web, in which case the printingly operative peripheral length of the blanket, which comes into contact with the web, is adjusted in dependence on the length of the print image. That can be effected steplessly. It will be appreciated however that the blanket can also be fixed to the peripheral surface of the transfer cylinder by adhesive means, in which case its length corresponds in the peripheral direction to the length of the print image or a multiple thereof. When using a suitable adhesive for that purpose it is possible, when changing the print image format, to remove the blanket from the transfer cylinder and to secure a fresh blanket thereto by adhesive.

As nowadays printing inks which harden under the effect of UV-radiation are generally employed it is desirable in accordance with a preferred feature of the invention to associate a UV-radiating means with the impression cylinder, in such a way that the print image on the web is exposed to the action of the UV-radiation as early as possible after it has been applied to the web so that the printing ink hardens as quickly as possible and, after the web has come away from the impression cylinder, the web can be changed in direction as soon as possible in order in that way to keep the structure of the printing station compact.

In that respect in accordance with another preferred feature of the invention it may be desirable to cool the web after it has passed the UV-radiating means. That can be easily effected while the web is already passing the impression cylinder which for that purpose can be in the form of a cooling roller. At any event if possible the procedure adopted should be such that the web does not experience any heating effect, due to the UV-radiation, which could result in unacceptable stretching or shrinkage of the web. That is important in particular if the web comprises plastic material and/or the machine has a plurality of printing stations arranged in succession, through which the web is successively passed, as is the usual practice in multi-color printing.

Further objects, features and advantages of the invention will be apparent from the description hereinafter of two preferred embodiments of the invention.

DESCRIPTION OF PREFERRED EMBODIMENTS

Figure 1:
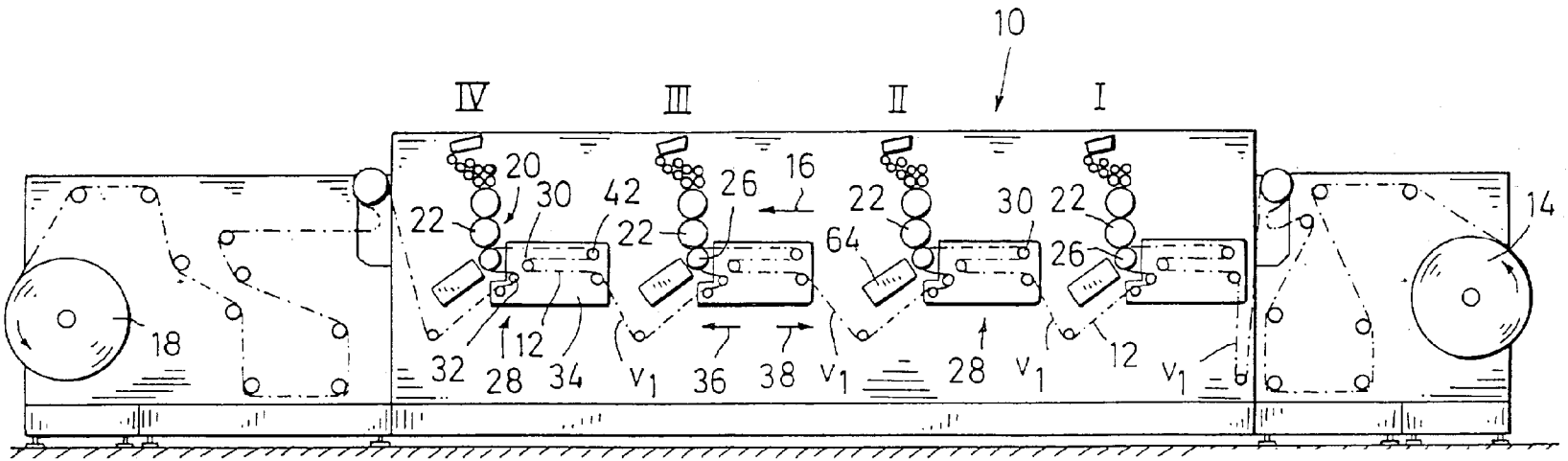
FIG. 1 is a diagrammatic side view of a printing machine having a plurality of printing stations.

Referring firstly to FIG. 1, shown therein is a printing machine 10 for printing on material in web form, as generally indicated at 12, which is drawn off a first roll 14 and passed in a general transportation direction indicated by an arrow 16 through first through fourth printing stations I–IV arranged in succession in the transportation direction 16. The printing stations are each of substantially the same structure. After the complete printing operation has been effected by the web 12 passing through the printing stations the web 12 is then wound on to a second roll 18.

Each printing station I–IV is provided with a printing mechanism which is generally indicated by reference numeral 20 in the printing station IV, and devices for transporting, positioning and guiding the web 12 to be printed upon, in the region of the respective printing station. The web passes into each respective printing station at a constant intake speed indicated at $V_1$.

Figure 2:
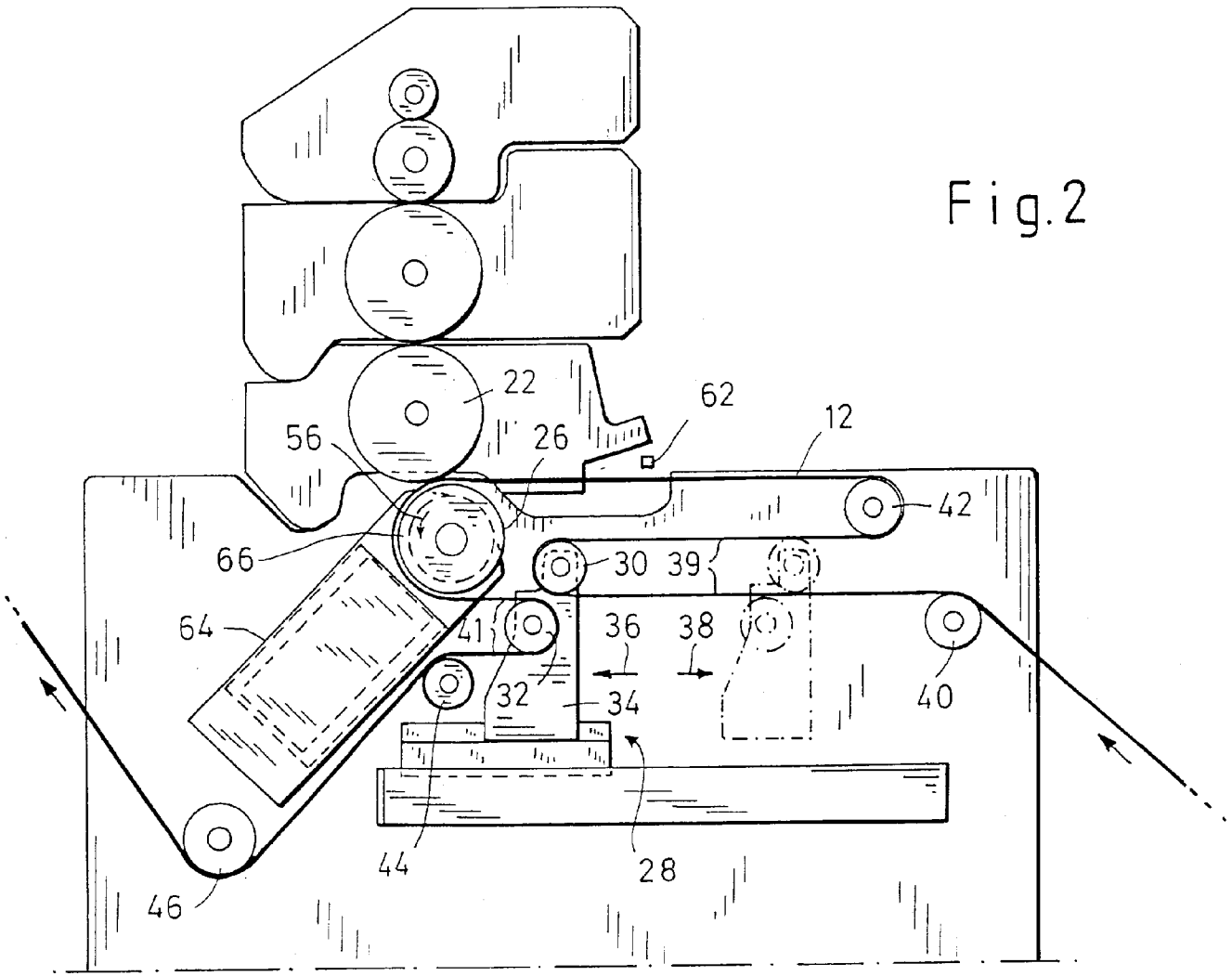
FIG. 2 is a diagrammatic side view of a printing station on an enlarged scale, FIGS. 3A through 3C each show a greatly simplified part of the structure shown in FIG. 2 on an even larger scale showing the co-operating components in three positions which occur in succession during a working cycle.

In the embodiment shown in FIG. 1 the printing stations are in the form of cylinder printing mechanisms whereas the printing mechanism shown in FIG. 2 is in the form of a short printing mechanism. Both types of printing mechanism can be employed here and the general structure thereof involves generally known design configurations so that they do not need to be described in greater detail at this juncture.

Figure 4:
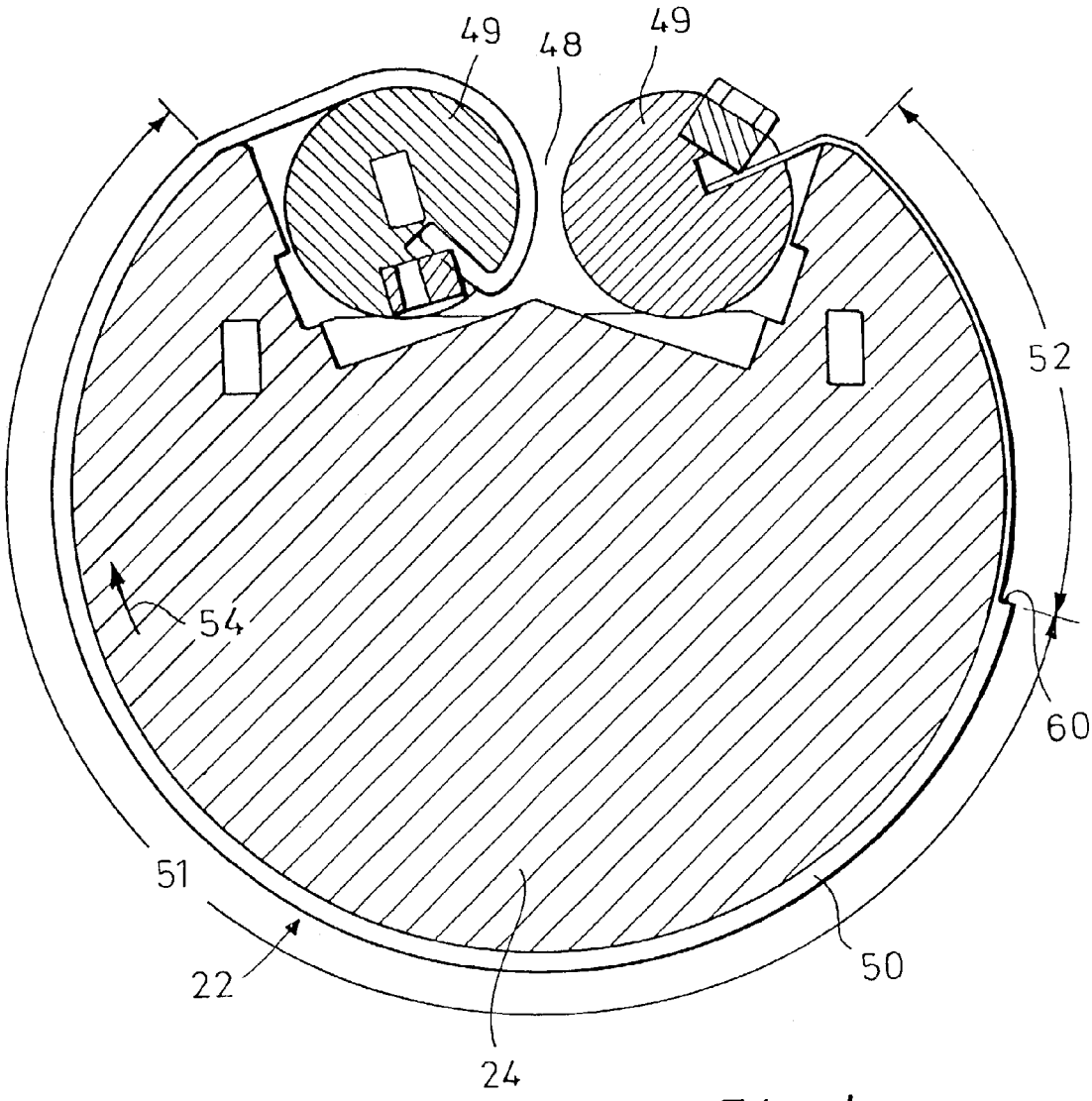
FIG. 4 is a partly sectional side view of a transfer cylinder.

As can be seen from both FIGS. 1 and 2 each printing mechanism in a printing station is provided with a transfer cylinder 22 comprising a substantially cylindrical main body indicated at 24 in FIG. 4 and a releasably mounted carrier for the print image which is to be transferred from the transfer cylinder 22 on to the web of material 12. In the embodiments illustrated here the carrier is a printing blanket, more specifically a rubber blanket, so that the transfer cylinder can also be referred to hereinafter as the blanket cylinder, the structure of which can be seen in greater detail from FIG. 4 to which reference will subsequently be made.

Still looking at FIGS. 1 and 2, operatively associated with the blanket cylinder 22 is an impression cylinder 26 to which the web 12 is fed by way of a compensation device 28. The compensation device has an undriven roller 30 carried by a carriage or slider 34 which is arranged linearly reciprocatably in the direction of arrows indicated at 36 and 38 in both FIGS. 1 and 2. The web 12 is fed to the respective printing mechanism by way of the roller 30, forming a first loop 39 which has first and second parallel web portions, and by way of a further, also undriven but stationary roller 42 around which the web is deflected in a direction towards the impression cylinder 26. In the printing mechanism the web guided by the impression cylinder 26 comes into contact with the peripheral surface of the blanket cylinder 22 for the purposes of transferring a print image on to the web 12.

From the impression cylinder 26 the web 12 passes out of the printing station 20, with the formation of a second loop 41, by way of a second roller 32 of the compensation device 28 and a further stationary deflection roller 44. Downstream of the second compensation roller 32 in the direction of transportation movement 16, the web is again moving at a constant exit speed $V_1$ which is equal to the intake speed $V_1$ upstream of the stationary guide roller 40 which is arranged upstream of the first roller 30 of the compensation device 28.

Reference will now be made generally to FIGS. 3A through 3C and FIG. 4 showing that the blanket cylinder 22 has a recess or cut-out 48 in which are disposed two clamping devices indicated at 49 in FIG. 4 of any suitable nature. A respective end of the blanket 50 is secured to each of the two clamping devices 49 in such a way that the blanket 50 is tensioned over the arcuate peripheral portion of the blanket cylinder 22 and in that respect forms the operative peripheral surface thereof. In the embodiment shown in FIGS. 3A through 3C the portion of the blanket 50 which forms the peripheral surface of the blanket cylinder 22 and which comes into contact with the web 12 as it is passed over the impression cylinder 26 in a revolution of the blanket cylinder 22 and thus constitutes the printingly operative portion of the blanket extends over about 280°. That corresponds to the largest possible length of print image because the blanket 50 is of the largest possible length as an operative printing portion in the peripheral direction, which is represented as the difference between a peripheral extent of 360° and the peripheral portion of the recess 48.

As however the printing mechanism is to be such that it can be employed for different lengths of print image in the direction in which the web of material 12 moves, without having to use blanket cylinders of different diameters, it is desirable for the blanket 50 to be provided with a peripheral portion of reduced thickness, as indicated at 52 in FIG. 4, in a part thereof which is supported by the arcuate peripheral portion of the blanket cylinder. In that respect, only the other peripheral portion 51 which is of normal thickness is operative to apply printing and therefore comes into contact with the web 12. In contrast the portion 52 of reduced thickness does not come into contact with the web 12 as it is passed over the impression cylinder 26, upon rotation of the blanket cylinder 22, and is thus not operative to apply printing to the web.

Figure 3A:
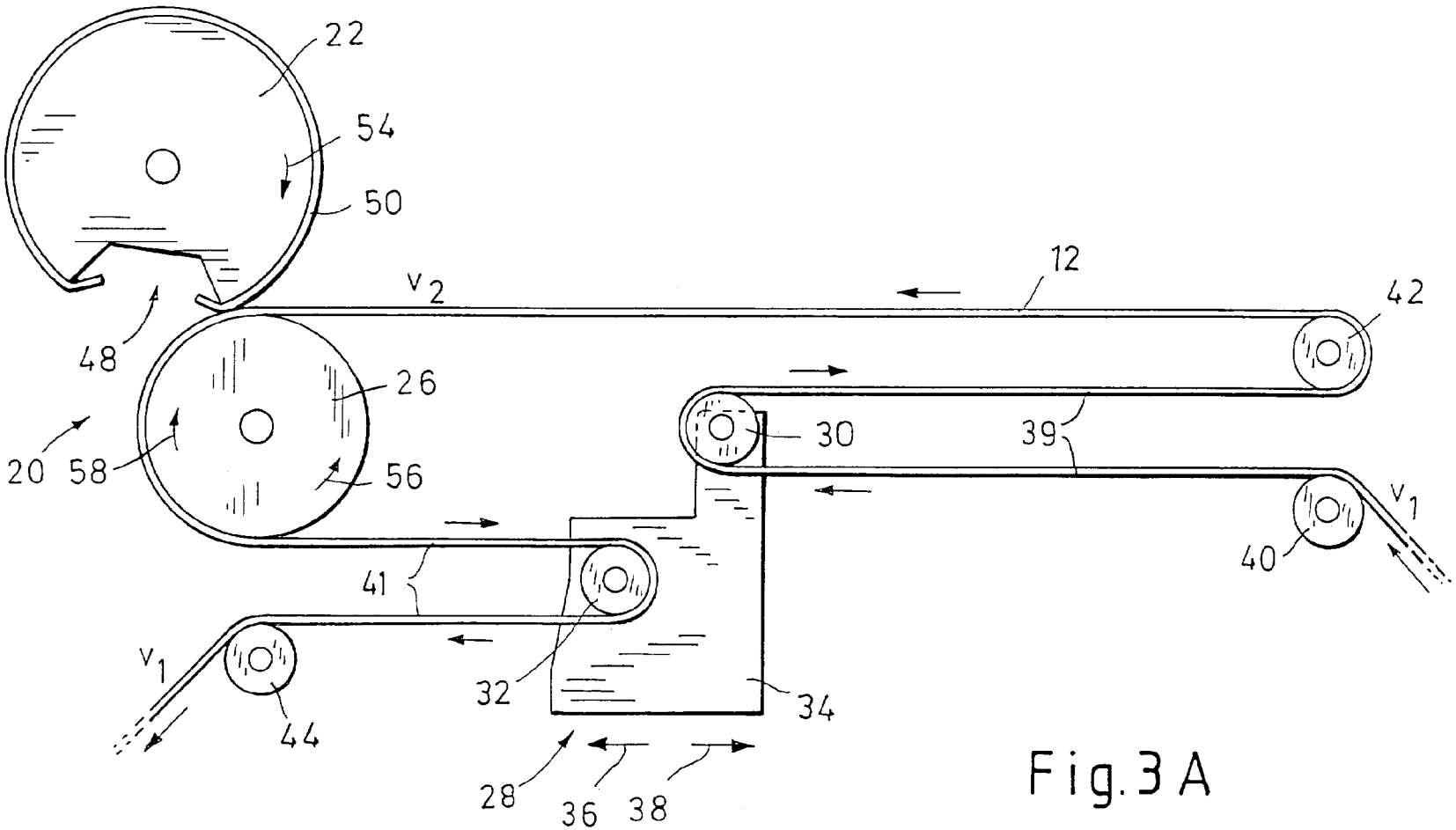
Figure 3B:
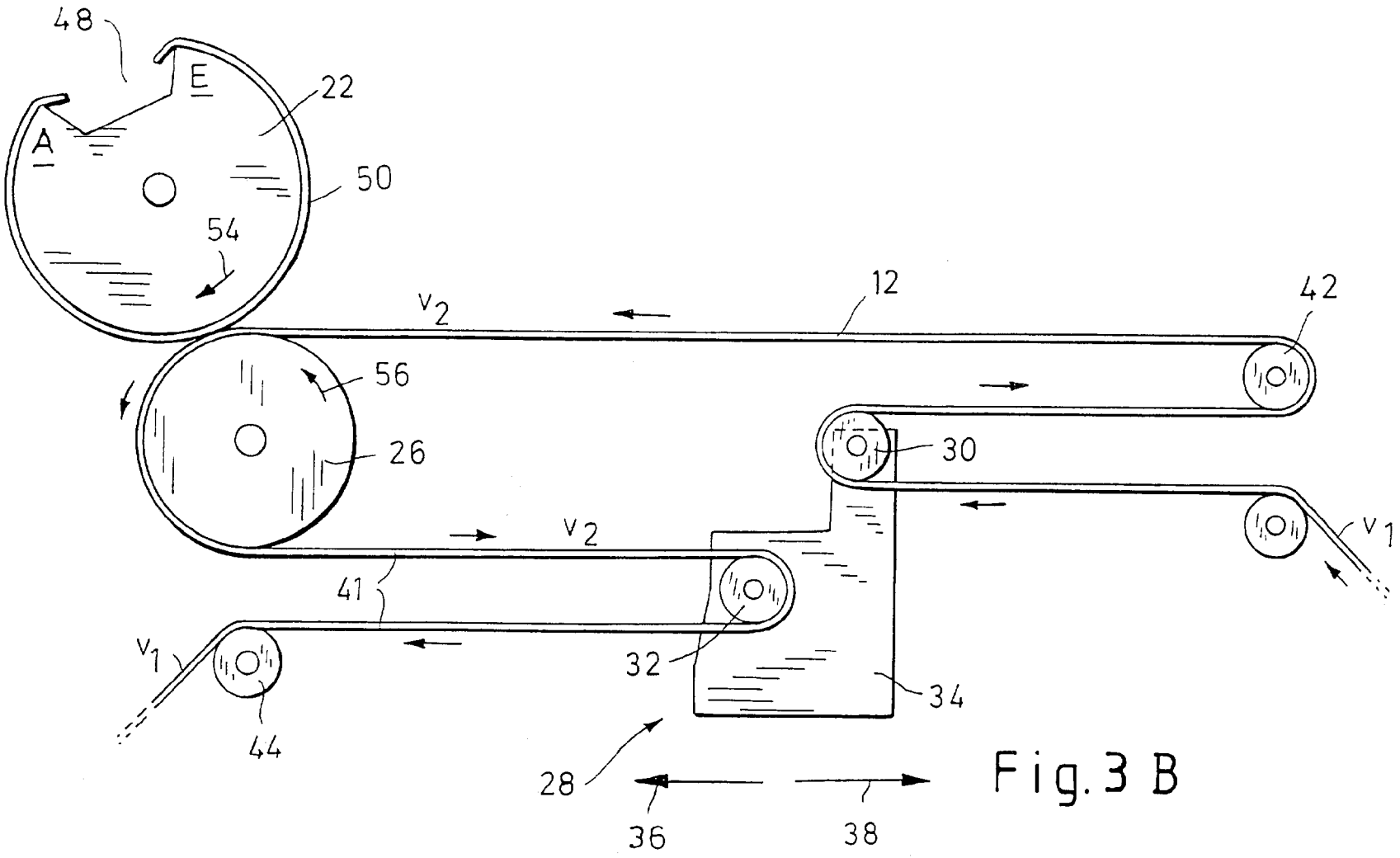
Figure 3C:
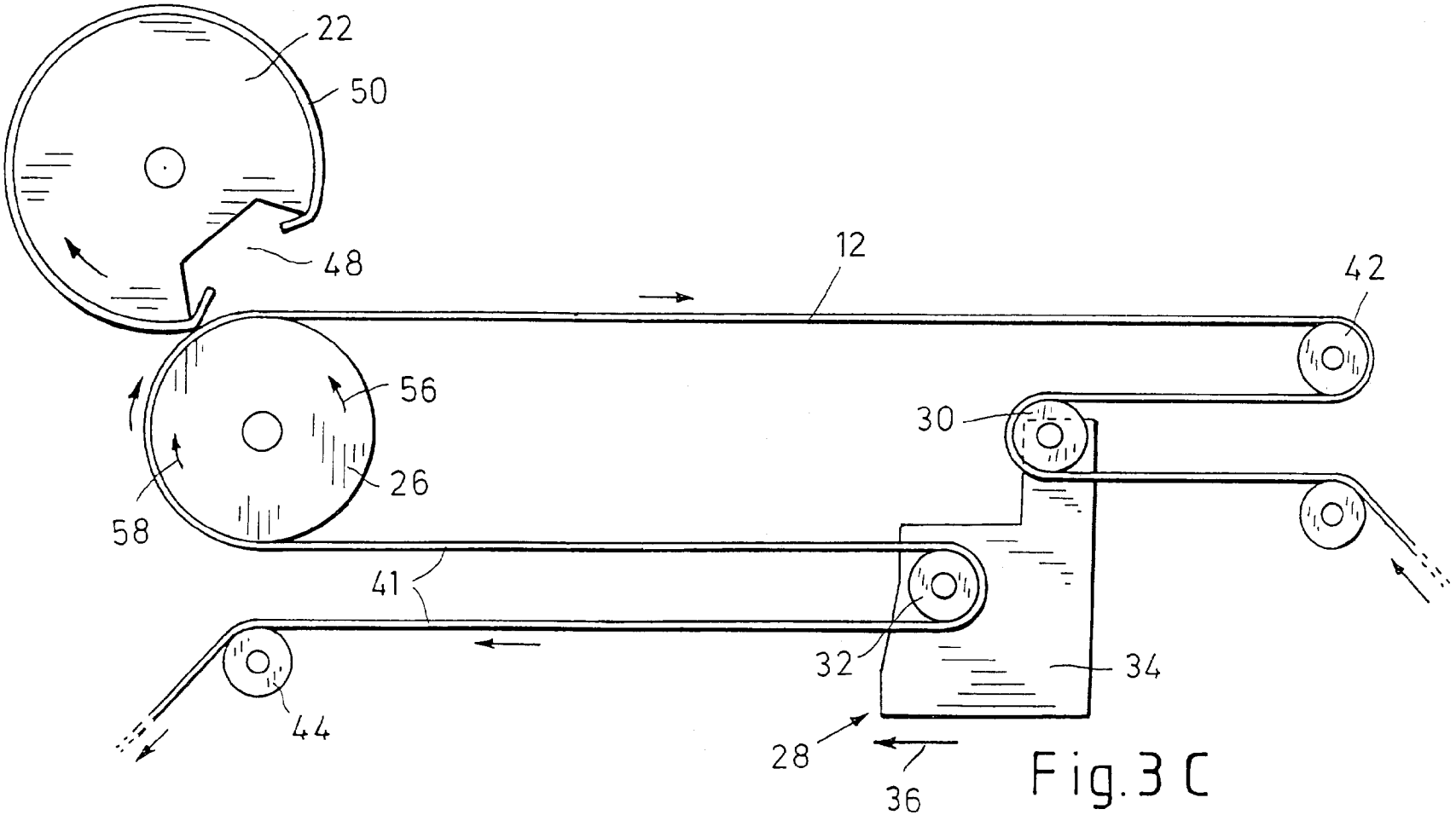

Adaptation of the blanket cylinder 22 to the respective length of print image is effected by a suitable choice or setting of the printing blanket 50. When changing the print image for example from a length as shown in FIGS. 3A through 3C to a shorter length as shown in FIG. 4 therefore it would be possible to fit a different printing blanket provided with a correspondingly dimensioned portion 52 of reduced thickness. There is however also the possibility of using a printing blanket which, over the maximum possible length in the peripheral direction, is of the thickness required for contact with the web of material but which in addition is also integrally provided with an additional portion, for example involving the thickness of the portion indicated at 52 in FIG. 4, which at any event remains out of contact with the web 12. A printing blanket of that kind is to be suitably fitted to and adjusted on the blanket cylinder 22, in accordance with the respective printing requirements involved.

In regard to the embodiments illustrated in the drawings that would mean that, in the case of the structure shown in FIGS. 3A through 3C, the portion 52 of reduced thickness would be wound into or otherwise disposed in the clamping device which is arranged in the recess 48. In contrast in the case of the structure shown in FIG. 4 the printing blanket is so arranged that a part of its portion of reduced thickness is disposed on the peripheral surface of the blanket cylinder 22 so that, in a revolution of the blanket cylinder 22, the blanket 50 is out of contact with the web 12 in a peripheral region thereof which corresponds to the sum of the arcuate portion constituted by the recess 48 and the arcuate portion constituted by the portion 52 of reduced thickness of the blanket. In that case a part of the portion which is of the thickness required for making printing contact with the web 12 is wound into one of the clamping devices 49. Preferably the portion 52 of reduced thickness of the blanket is arranged downstream of the recess 48 adjoining same, in the direction of rotation as indicated at 54 of the blanket cylinder 22.

Having broadly discussed the structure of the apparatus according to the invention, a printing operation and the functions of the component parts which co-operate in a printing operation will now be described with reference more specifically to FIGS. 3A through 3C and FIG. 4.

In the position of the apparatus as shown in FIG. 3A the blanket cylinder 22 which rotates continuously in the direction indicated by the arrow 54 is approximately in a position at the beginning of an actual printing operation, in which the initial region, which is in front of the recess 48 in the direction of rotation 54, of the blanket 50 forming the peripheral surface of the cylinder, has just come into contact with the web of material 12 which is being passed around the impression cylinder 26. The web of material is fed to the arrangement over the guide roller 40 at a constant speed $V_1$ of for example 30 m/min. The peripheral speed of the blanket cylinder 22 and the impression cylinder 26 and thus also the speed of movement $V_2$ of the web 12 in the region of those two cylinders are however greater and for example are 35 m/min.

FIG. 3B shows an intermediate stage in the printing operation, in the course of which there is applied to the web 12 a print image which approximately corresponds to the length of the periphery of the blanket cylinder 22 less the peripheral portion corresponding to the recess 48.

As soon as transfer of the respective print image is concluded in the course of the further rotary movement of the blanket cylinder 22 in the direction of the arrow 54 and the blanket 50 comes out of contact with the web 12, and therefore the position adopted is that shown in FIG. 3C, the drive for the impression cylinder 26 which is controlled in accordance with a suitable program is regulated in such a way that firstly the rotary movement in the direction of the arrow 56 is slowed down and, after the value of zero is reached, a rotary movement of the impression cylinder 26 is effected in the opposite direction, being therefore in the direction indicated by the arrow 58, so that the web 12 which during that phase is out of contact with the blanket cylinder 22 also moves in the opposite direction between the impression cylinder 26 and the deflection roller 30. After the web 12 has covered a sufficient distance in that opposite direction, the rotary movement of the impression cylinder 26 in the direction of the arrow 58 is again reduced to zero in order immediately thereafter to cause the impression cylinder 26 to rotate in the direction of the arrow 56 again and to accelerate it to the rotary speed which corresponds to the peripheral speed of the blanket cylinder 22. That rotary speed of the impression cylinder 26 in the direction of the arrow 56 is attained at latest at the moment in time at which the blanket 50 of the blanket cylinder 22 comes into contact with the web 12 again to apply the next print image, as shown in FIG. 3A.

It will be seen therefore that the above-described procedure provides for positioning of the web relative to the blanket cylinder 22 which rotates continuously in the direction of the arrow 54, so that the respective next print image can be transferred on to the web without a spacing or with only a slight spacing in relation to the print image applied in the preceding working cycle.

The compensation slider 34 performs linear movements corresponding to the above-described sequence of rotary movements of the impression cylinder 26. During a first phase in the working cycle in which the printing step is implemented, the slider 34 which is controlled in its movements in accordance with a suitable program, with the two freely rotatable rollers 30, 32, is displaced in the direction indicated by the arrow 38 in order in that way, with the web 12 being continuously supplied at the speed $V_1$, to reduce the distance between the compensation roller 30 and the deflection roller 42 whereby additional web material is made available in the region between the compensation roller 30 and the impression cylinder 26, thus resulting in an increase in the speed of movement of the web 12 in the region between the roller 30 and the impression cylinder 26 to for example a value of 35 m/min and thus the resulting speed of the web 12 corresponds to the printing speed, that is to say the peripheral speed of the two cylinders 18 and 26. As the printing speed is constant the movement of the compensation slider 34 in the direction of the arrow 38 also takes place during the printing operation at a constant speed $V_3$. That speed $V_3$ can be expressed in the form of the equation $V_3/2=V_2=V_1$.

As soon as the blanket cylinder 22 has reached the position shown in FIG. 3C in which the cylinder 22 or more specifically the blanket 50 thereon comes out of contact with the web of material 12, the slider 34, in accordance with the reduction which now occurs in the rotary movement of the impression cylinder 26 in the direction of the arrow 56, also moves at a correspondingly decreasing speed in the direction indicated by the arrow 38 in FIG. 3B, until the speed of the web of material 12 between the deflection roller 42 and the impression cylinder 26 becomes less than the speed $V_1$, at which the web of material 12 is fed to the compensation roller 30.

As soon as this takes place the slider 34 is displaced in the direction indicated by the arrow 36. In that situation the speed of the slider 34 in that direction correspondingly increases with a reducing speed of rotary movement of the impression cylinder 26 in the direction of the arrow 56 and subsequent reversal of the rotary movement to rotate in the direction indicated by the arrow 58.

Implementation of the next working cycle presupposes that firstly the rotary movement of the impression cylinder 26 in the direction of the arrow 58 and the corresponding opposite movement of the web 12 are reduced to zero by a suitably programmed deceleration effect and then the impression cylinder 26 is again accelerated in the direction of the arrow 56, with simultaneous entrainment of the web 12 thereby, to the actual printing speed. In that case, the compensation slider 34 performs corresponding movements, namely during the deceleration phase a movement at decreasing speed in the direction of the arrow 36 and during the subsequent acceleration phase in the opposite direction 56 a movement in the direction indicated by the arrow 38 in FIG. 3B. The latter situation arises as soon as the speed of the web 12 is higher than the speed $V_1$ at which the web is fed to the arrangement. As already mentioned hereinbefore that movement in the direction of the arrow 38 takes place at a substantially constant speed as soon as the web has been accelerated to the speed required for the printing operation and which thus corresponds to the peripheral speed of the blanket cylinder 22 and the impression cylinder 26.

That operating condition must occur at the latest at the moment in time in which the blanket 50 comes into contact again with the web 12 supported by the impression cylinder 26, as shown in FIG. 3A, and the next working cycle begins, during which the impression cylinder 26 and the slider 34 are respectively rotated and displaced at a constant speed.

The function of the above-described operating movements of the impression cylinder 26 and the compensation slider 34 is to position the web 12 in such a way that, in spite of the presence of the recess 48 and possibly the portion 52 of reduced thickness of the blanket 50, the print images which are to be successively applied to the web 12 can be applied in immediately adjoining relationship or possibly with only a small spacing from each other, such spacing being substantially less than the travel length, as measured in degrees of angle, during which the blanket cylinder 22 or the blanket 50 thereon is out of contact with the web 12.

A further consequence of the above-described variations in respect of speed and direction of the rotary movement of the impression cylinder 26 is that the web 12 also runs off the impression cylinder 26 at correspondingly different speeds and in correspondingly different directions. It will be appreciated that, so that the web 12 is fed at a constant speed to the next following piece of equipment in the transportation direction, for example the next printing station, the web 12 as it leaves the impression cylinder 26 is passed over the second compensation roller 32. The two parallel runs of the web 12 forming a loop indicated at 41 passing around the compensation roller 32 thus experience, in dependence on the rotary movement of the impression cylinder 26, the same variations in length as the loop of incoming web material, which passes around the compensation roller 30, but in each case with the opposite sign and thus in the opposite direction. Accordingly this means that the web 12 moves out of the respective printing mechanism 20 at the same constant exit speed $V_1$ as the speed at which it is also fed to the printing mechanism.

As the embodiment shown in FIGS. 3A through 3C provides that the blanket cylinder 22 or the blanket 50 thereon is in contact with the web 12 throughout the entire rotary movement from the position shown in FIG. 3A, representing the beginning of a printing operation, to the position shown in FIG. 3C, being the end of the printing operation, the only period of time available for appropriate positioning of the web 12 is the time that the blanket cylinder 22 requires, in the course of the rotary movement in the direction of the arrow 54, to move from the position shown in FIG. 3C into the position shown in FIG. 3A from which the respective following working cycle begins.

If in contrast the apparatus uses a blanket which, like that used in the embodiment illustrated in FIG. 4, has a peripheral portion 52 of reduced thickness which does not come into contact with the web to be printed, the period of time during which the blanket cylinder 22 is not in contact with the web corresponds to a longer peripheral distance than in the embodiment shown in FIGS. 3A through 3C as the contact between the blanket cylinder 22 and the web 12 is terminated at the moment at which a step indicated at 60 in FIG. 4, which forms the point of separation between the two regions of differing thicknesses of the blanket 50, passes the position of the impression cylinder 26, at which the blanket is normally in contact with the web 12. This means that normally, in a structure in which the length of the blanket 50 which is operative to produce printing extends over the entire region of the transfer or blanket cylinder with the exception of the recess 48, is available for positioning of the web 12 for the following working cycle, for less time than in the case of a construction in which a portion of the blanket is of such a small wall thickness that it remains out of contact with the web 12.

On the other hand a constant duration of a working cycle, irrespective of the length of the print image to be applied, that is to say a uniform speed of rotary movement of the blanket cylinder 22 independently of the length of a print image, entails the consequence that the speed $V_1$ at which the web 12 is introduced into the respective printing station is higher when the print image is of a greater length than when it is of a shorter length, as the length of web which is to be supplied to the printing arrangement per unit of time is greater when the aim is to produce a longer print image than when a shorter print image is involved. The consequence of this is that, with a decreasing length of print image, because of the lower web intake speed $V_1$, the difference between the intake speed $V_1$ on the one hand and the printing speed on the other hand increases and thus the speed at which the compensation slider 34 has to be moved during the printing operation increases with a decreasing length of print image and thus more time is required for positioning the web 12 between two successive printing operations, as more time is correspondingly required for the acceleration and deceleration phases in the positioning procedure if certain maximum values are not to be exceeded during acceleration and deceleration.

As the web 12 is driven in both directions in the printing station by the impression cylinder 26, the angle with which the web 12 passes around the impression cylinder 26 should not be less than a certain minimum value in order in that way to avoid slippage between the impression cylinder 26 and the web 12 and to achieve the highest possible level of accuracy in terms of the movement of the web 12 relative to the blanket cylinder 22. The magnitude of the angle required for the web 12 to pass around the impression cylinder 26, which in the illustrated embodiments is about 180°, can be established at any time by suitable tests. In addition, to achieve the desired accuracy, it is advantageous for the drive for the impression cylinder 26 and possibly the blanket cylinder 22 to be implemented by a respective torque motor which, without a transmission arrangement or other mechanical intermediate members, drives the shaft of the respective cylinder with a suitably high degree of accuracy so that the amount of space required for such a drive is also slight.

A corresponding consideration also applies in regard to the drive for the compensation slider 34 for which it is possible to use a linear motor which affords precise movement of the compensation slider 34, for example under the control of a suitable program. Furthermore it may also be advantageous to control or regulate the movements of the compensation slider 34 in dependence on the tension in the web 12. It will be appreciated that it is essential to maintain a constant tension in the web in order to provide for accurate guidance of the web relative to the transfer or blanket cylinder 22. Accordingly it is possible to implement a procedure wherein the tension in the web 12 is preferably continuously measured and, in the event of a deviation from a reference value, the drive for the compensation slider 34 is influenced for example in small regulating steps in such a way that the actual tension in the web 12 again corresponds to the reference tension. The procedure involved in influencing the speed of movement of the compensation slider 34 in dependence on the tension in the web 12 could be superimposed on the program for controlling or regulating the movement of the slider 34. Such influence however is very slight in terms of its extent, and normally in any case it will usually substantially coincide with the influencing parameters supplied by the control program, in terms of the speed and direction of movement of the web.

In order to achieve the highest possible level of accuracy in regard to alignment of the web 12 with the blanket cylinder 22 the procedure can also be such that the web 12 is provided with markings which can be detected by at least one photoelectric cell indicated at 62 in FIG. 2 and the drive for the impression cylinder 26 can be regulated or controlled in dependence on the position of the web as defined by the register marks. That can possibly be implemented in addition to a program for controlling the drive. It is further possible for the drive for the blanket cylinder 22 also to be controlled or regulated using register marks of that kind, possibly in addition to a program for controlling the blanket cylinder 22, insofar as, during the time for which the transfer or blanket cylinder 22 is not in contact with the web, the peripheral position of the blanket cylinder is oriented in relation to the web 12 in small regulating steps for the respectively following printing operation. The influence, effected by such regulating steps, on the rotary speed of the blanket cylinder 22 is however so slight that the deviation possibly caused thereby from the predetermined constant speed of rotation of the blanket cylinder 22 is negligible in relation to the duration of a working cycle.

It will be noted that the above-described possible procedure of additionally regulating the transportation movement of the web by means of markings which are detected by photoelectric cells or other suitable devices and which indicate the position of the web is particularly advantageous when a web which is already provided with print images thereon is to be printed upon yet again, in which case the new print images to be applied to the web have to be suitably oriented in relation to the print images which are already on the web. That is the case for example in a multi-color printing operation.

In consideration of the fact that printing inks which harden under the effect of UV-radiation are predominantly used, operatively associated with the impression cylinder 26 is a device as indicated at 64 in FIG. 2, by means of which the printed web 12 is subjected to irradiation with UV light. That provides that the printing ink is substantially dry when the web 12 leaves the impression cylinder 26. That affords the possibility of the web 12 experiencing a change in direction around the compensating roller 32 shortly after the driving impression cylinder 26 in the direction of movement of the web 12, in order in that way to provide that the distances covered by the web within the printing station are as short as possible.

As the web 12 experiences a certain rise in temperature due to the effect of the UV radiation acting thereon, the impression cylinder 26 is provided with at least one cooling duct indicated at 66 in FIG. 2, through which flows a cooling medium, for example water. Cooling the web 12 in that way prevents unacceptable shrinkage and/or stretching of the web, caused by the heating action thereon, which could also adversely affect the degree of accuracy with which the web is positioned in relation to the blanket cylinder 22. Cooling of the web for the purposes of avoiding an unacceptable rise in temperature thereof can be important in particular when, as in the case of the apparatus illustrated in FIG. 1, the web is passed through a plurality of successively arranged printing stations, each of which is provided with a UV-radiating device.

It will be appreciated however that cooling can also be effected by other means, for example by means of a flow of cooling air which is blown against the printed web.

Although the invention has been described hereinbefore essentially in relation to an offset printing process, it will be appreciated that the invention can also be applied in regard to other printing and decorating processes. Thus the invention can also be used in relation to relief printing, for example flexographic printing, intaglio printing and rotary screen printing, but also in relation to stamping or embossing, in particular hot stamping or embossing, without however that list of possible processes being exhaustive. In all cases the web to be printed upon or decorated is to be positioned, in a phase in a working cycle, in such a way that the print images to be applied in succession are without any spacing therebetween or are at only a small spacing from each other, adaptation to different image lengths preferably being effected by suitable adjustment of the web intake speed $V_1$. In all cases the transfer or blanket cylinder may be of a constant diameter irrespective of the length of the respective print image, in terms of its peripheral surface which is operative to apply the printing.

It will be appreciated that the above-described embodiments have been set forth solely by way of example and illustration of the principles of the invention and that various modifications and alterations may be made therein without thereby departing from the spirit and scope of the invention.

What is claimed is:

1. A method of printing a web comprising the steps of:

providing at least one printing station, wherein said web enters said station at an intake speed and exits said station at an exit speed;

moving the web in a direction towards said at least one printing station at an intake speed;

providing a transfer cylinder, wherein said cylinder includes a periphery, said periphery having a portion which is in contact with said web for less than a full 360° revolution of said cylinder;

applying at least one printing image to said web in said at least one printing station from said transfer cylinder;

moving the web in said printing station at a rate which is higher than said intake speed during a printing operation;

providing an impression cylinder which is operatively associated with said transfer cylinder, said impression cylinder having a periphery, and wherein said impression cylinder contacts said web and causes said web to move;

altering the movement of said web in said at least one printing station to position said web relative to said transfer cylinder for a following printing operation, wherein said alteration is implemented by a change in the rotational direction of said impression cylinder;

providing a first compensation device;

allowing the first compensation device to adjust the movement of said web to compensate for differences between the intake speed of said web and the movement of said web caused by said change in rotation of said impression cylinder.

2. The method of claim 1, further including the steps of:

providing a second compensation device; and allowing the second compensation device to adjust the movement of said web to compensate for differences between the speed of the web exiting said at least one printing station and the movement of said web caused by said change in rotation of said impression cylinder.

3. The method of claim 1, further including the step of forming a first loop in said web upstream of said impression cylinder, said first loop having a length, wherein said length of said first loop may vary due to a change in rotation of said impression cylinder.

4. The method of claim 2, further including the step of forming a second loop in said web downstream of said impression cylinder, said second loop having a length, wherein said length of said second loop may vary to provide a constant speed of said web exiting said at least one printing station.

5. The method of claim 4, wherein said exit speed corresponds to said intake speed.

6. The method of claim 1, wherein said transfer cylinder includes a rubber printing blanket covering at least a portion of said periphery.

7. The method of claim 6, wherein said blanket includes a first portion having a reduced thickness which does not contact said web and a second portion for applying said printing image which contacts said web, wherein said second portion has a length and said printing image has a length and wherein the length of said second portion is adjusted depending on said image length.

8. The method of claim 2, wherein said first loop is formed by said first compensation device and wherein said second loop is formed by said second compensation device and wherein said first and said second compensation devices for adjusting the direction of movement of said web act jointly.

9. The method of claim 1, wherein said printing image comprises printing ink and wherein said printing ink is subjected to ultraviolet radiation to dry said printing image as said web contacts said impression cylinder.

10. The method of claim 9, wherein said impression cylinder is capable of cooling said web.

11. The method of claim 1, wherein said rotation of said impression cylinder is controlled by a program.

12. The method of claim 1, wherein the direction of rotation of said impression cylinder depends upon the position of said web in said at least one printing station.

13. The method of claim 12, wherein the position of said web for causing a change in the rotation of said impression cylinder depends upon the position of said portion of said periphery of said transfer cylinder which is not in contact with said web.

14. The method of claim 2, wherein said web is held at a tension and said first and said second compensation devices control the tension of said web.

15. The method of claim 1, wherein said web contacts said impression cylinder for at least one half of its periphery.

16. The method of claim 1, wherein said impression cylinder is driven by a torque motor.

17. The method of claim 2, wherein said compensation devices are driven by a linear motor.

18. The method of claim 1, wherein said web comprises a material, the method further including the steps of providing a web intake and a web exit and wherein said web is continuously transported under a tension that is suited to said material from said intake through said at least one printing station to said web exit and wherein said tension is maintained on said web from said intake to said exit.

* * * * *